United States Patent [19]

Oswald

[11] 4,438,623

[45] Mar. 27, 1984

[54] GRIPPER APPARATUS ON A RING SPINNING OR RING TWISTING MACHINE

[75] Inventor: Peter Oswald, Matzingen, Switzerland

[73] Assignee: Rieter Machine Works Ltd., Winterthur, Switzerland

[21] Appl. No.: 396,915

[22] PCT Filed: Oct. 31, 1981

[86] PCT No.: PCT/EP81/00174

§ 371 Date: Jul. 1, 1982

§ 102(e) Date: Jul. 1, 1982

[87] PCT Pub. No.: WO82/01727

PCT Pub. Date: May 27, 1982

[30] Foreign Application Priority Data

Nov. 13, 1980 [CH] Switzerland ..... 8428/80

[51] Int. Cl.[3] ..... D01H 9/00; B66C 1/46

[52] U.S. Cl. ..... 57/275; 294/87 R; 294/93; 294/99 R

[58] Field of Search ..... 57/266, 267, 274, 275; 294/93, 64 R, 87 R, 88–90, 99 R, 100, 102 R

[56] References Cited

U.S. PATENT DOCUMENTS

| | | | |
|---|---|---|---|
| 3,327,450 | 6/1967 | Carter | 294/93 X |
| 3,367,098 | 2/1968 | Schulz | 57/275 |
| 3,462,934 | 8/1969 | Schulz et al. | 57/275 |
| 3,667,204 | 6/1972 | Burgermeister et al. | 57/275 |
| 3,714,770 | 2/1973 | Rothke | 57/275 |
| 3,835,633 | 9/1974 | Klein | 57/275 |
| 3,945,486 | 3/1976 | Cooper | 294/99 R X |
| 4,173,368 | 11/1979 | Haverbusch | 294/93 X |

FOREIGN PATENT DOCUMENTS

| | | |
|---|---|---|
| 1008645 | 5/1957 | Fed. Rep. of Germany . |
| 1532603 | 2/1970 | Fed. Rep. of Germany . |
| 1282526 | 5/1973 | Fed. Rep. of Germany . |
| 500303 | 1/1971 | Switzerland . |

*Primary Examiner*—John Petrakes

*Attorney, Agent, or Firm*—Werner W. Kleeman

[57] ABSTRACT

The present invention relates to a gripper apparatus on a ring spinning or ring twisting machine for gripping empty and/or wound bobbin tubes using pegs mounted on a support beam extending along the machine and inserted into the interior space of the bobbin tubes, the bobbin tubes being gripped by pressing each bobbin tube and the peg inserted into it against each other. The pressing generally is effected using compressed air. According to the invention at each peg a cylindrical extension made of elastically bendable material is provided, which extension extends from the front end of the peg towards the tip thereof.

This arrangement yields the advantage that in case of faulty positioning of bobbins, tubes a head-on collision of the peg front end on the upper bobbin tube rim, with accordingly grave consequences, such as e.g. damage to the support beam or blowout of the compressed air, no longer can occur.

12 Claims, 4 Drawing Figures

GRIPPER APPARATUS ON A RING SPINNING OR RING TWISTING MACHINE

BACKGROUND OF THE INVENTION

The present invention relates to a new and improved gripper apparatus on a ring spinning or ring twisting machine for gripping empty and/or wound-on bobbin tubes using pegs arranged on a beam extending along the machine, which pegs can be inserted, by suitably moving the beam, into the cylindrical interior spaces of the bobbin tubes, one peg being provided for each bobbin tube, and the pegs being tapered-off at their front end, which is inserted, in which arrangement the gripped bobbins are held by mutually pressing a bobbin tube and a peg inserted into its interior space against each other.

In textile processing, bobbin tubes or bobbin packages in various operations are gripped automatically to be transported from one location to another. As known e.g. from German Pat. No. 1,282,526 and from Swiss Pat. No. 500,303, particularly on ring spinning or ring twisting machines in many cases a plurality of such bobbin tubes or of bobbin packages, respectively, is to be gripped simultaneously. For this purpose gripper devices, arranged on a beam, are inserted into the cylindric interior spaces of the bobbin tubes or of the bobbin packages, respectively, and by pressing these gripper devices and the bobbin tube inside wall against each other, the bobbin tubes are gripped.

In this type of gripping of the bobbin tubes or the bobbin packages cases occur more or less frequently, in which one of the gripper devices is not inserted correctly into the cylindrical interior space of the bobbin tube. This disadvantage is due, if a plurality of bobbin tubes is to be gripped simultaneously, to inaccurate positioning of one of the bobbin tubes, the probability of such inaccurate positioning increasing with the number of bobbin tubes to be gripped simultaneously. For still achieving correct insertion of the gripper device into a bobbin tube even in case the latter is somewhat inaccurately positioned, it is known that the front end of the gripper device, which is to be inserted into the interior space of the bobbin tubes, is tapered-off conically.

This measure improves the conditions. However, the case can still occur, in which the point of the tapered-off front end of the gripper device, to be inserted into the bobbin tube, collides with the upper rim of the bobbin tube head-on. In this case, if pegs of hard material are used, the bobbin tube, the peg or even the beam for the gripper devices, or the elements guiding and moving the beam respectively, can be damaged; on inflatable, bendable gripper devices cracks can develop, in such manner, that these gripper devices have to be replaced. Due to such cracks furthermore the compressed air required for inflating the gripper devices escapes, which can cause prolonged down time. Such damages thus can be of serious nature.

SUMMARY OF THE INVENTION

Therefore, with the foregoing in mind it is a primary object of the present invention to provide an improved construction of gripper apparatus on a ring spinning or on a ring twisting machine which is not associated with the aforementioned limitations and drawbacks of the prior art constructions.

Now in order to implement this and still further objects of the invention, which will become more readily apparent as the description proceeds, the gripper apparatus of the present development is manifested by the features that each peg is provided with a cylindrical extension made from elastically bendable material, which extends from the tapered-off front end of the peg towards the front.

If, due to misaligned, faulty position of a bobbin, a head-on collision of a front end of a peg on the upper bobbin tube rim would occur, in the arrangement according to the invention the front end of the extension collides with this bobbin tube rim. As the insertion movement proceeds, the extension and subsequently the peg slides along the bobbin tube rim, the bobbin tube being pushed to the side in such a manner that damages are avoided. In this process the peg colliding with the bobbin tube rim either is inserted into the bobbin tube, or continues to move outside the bobbin tube, along the bobbin tube.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

It is to be understood that in order to simplify the illustration only enough of the construction of the gripper apparatus has been shown as needed for those skilled in the art to readily understand the underlying principles and concepts of the invention.

As already known, on ring spinning and ring twisting machines generally a large number of spindles are lined up along the machine length. Furthermore, a transporting belt and a support beam with gripper elements extend along the machine length. In this arrangement the support beam is used for transferring bobbin tubes from the transporting belt to the spindles, or for transferring bobbin packages (wound bobbin tubes) from the spindles to the transporting belt.

Figure 1:
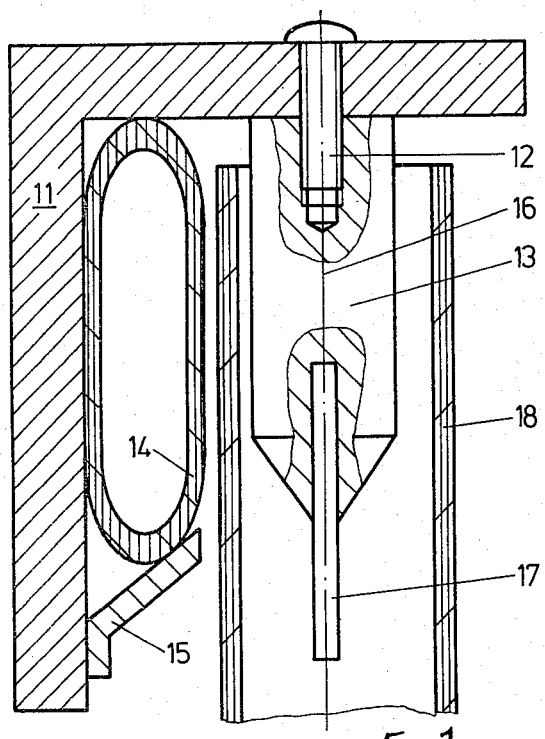
FIG. 1 illustrates a first embodiment of the gripper apparatus according to the invention including an extension mounted on a support member.

In FIG. 1 a support beam 11 of this type provided with a first embodiment of the gripper apparatus according to the invention is shown. Using a screw 12 a peg 13 is mounted thereon. The peg is made of a hard material, e.g. of a metal. In the longitudinal direction of the support beam 11, i.e. at right angles to the plane of the figure, a plurality of such pegs 13 are arranged mutually spaced. Also in the longitudinal direction of the support beam 11 a bendable hose 14 extends, which is mounted on the support beam 11 and on a support member 15. Into a bore, provided coaxially with the longitudinal axis 16 of the peg 13, an extension 17 is mounted.

This extension 17 is made of bendable material. A bobbin tube, into which the peg 13 is inserted, is designated 18. The peg 13 is tapered-off conically at its front end which is inserted into the bobbin tube 18.

For e.g. lifting bobbin tubes from the transporting belt (not shown) and to don them onto the spindles, the support beam 11 is moved towards the bobbin tubes located on the transporting belt in such a manner, that into the cylindrical interior space of each bobbin tube 18 a peg 13 each is inserted. After the peg 13 is inserted to its maximum insertion position, the air pressure inside the hose 14 is increased. Thus the hose 14 extends towards the peg 13 in such a manner, that the hose 14 and the bobbin tube 18 are pressed against each other. In this manner the bobbin tube 18 is held by the peg 13 and the neighbouring hose section. In the manner described, all bobbin tubes arranged on the transporting belt of the spinning or twisting machine can be gripped simultaneously and, using a corresponding movement of the support beam 11, can be donned onto the spindles.

The case now may occur, as mentioned initially already, that not all bobbin tubes arranged on the transporting belt are accurately located in their correct position. Owing to the conically tapered front end, which is inserted, of the peg 13 disturbance-free insertion of the peg 13 still is effected, even if the position of a bobbin tube deviates to a certain extent from the correct position. The case can occur, however, absence of the extension 17 being assumed, in which the frontmost part of the peg 13 collides exactly head-on with the upper rim of the bobbin tube 18. In this manner the peg 13, the bobbin tube 18, but also the support beam 11 and its moving devices could be damaged.

Provision of the extension 17 implies that under the above mentioned circumstances of faulty positioning the extension 17 can collide with the upper bobbin tube rim. In this case the extension 17 is bent in its free portion as the suport beam 11 is lowered further. In this process the bobbin tube 18 is pushed by the extension either into its correct position or aside. Thus expensive damages are precluded.

Figure 2:
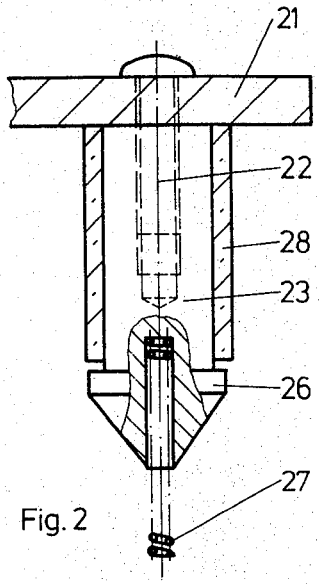
FIG. 2 illustrates a second embodiment of the gripper apparatus according to the invention including an extension designed as a helical spring.
Figure 3:
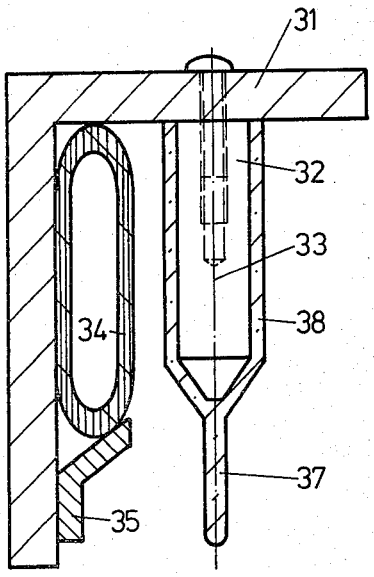
FIG. 3 illustrates a third embodiment of the gripper apparatus according to the invention including an extension forming an integral piece of material with the peg wall.

In FIG. 2 a support beam 21 is shown, which supports a row of pegs extending at right angles of the plane of the figure, all pegs of the row being identical with the peg 23. The pegs are mounted using screws 22. From the conically tapered section 26 again an extension 27 extends towards the front. In this second embodiment of the gripper apparatus according to the invention the extension consists of a helical spring. The peg 23 furthermore is surrounded by a sleeve 28, the surface of which is of relatively high holding friction. Using a surface of such type a bobbin tube pressed against the peg 23 is to be held more securely than as in contact with e.g. a smooth metal surface. In FIG. 3 again a support beam 31, a peg 33 mounted using a screw 32, a hose 34 and a support member 35 are shown. The peg 33, in this third embodiment of the gripper apparatus according to the invention, consists of a part made of rigid material, which is surrounded by a sleeve 38 forming an integral piece of material with an extension 37. An integral piece of material of this type presents the advantage of relatively simple manufacture. The end of the extension 37 is rounded-off in such a manner that, in case the end of the extension 37 collides with the bobbin tube rim, the sliding off of the extension 37, and thus of the moving aside of the bobbin tube, are effected more reliably.

Figure 4:
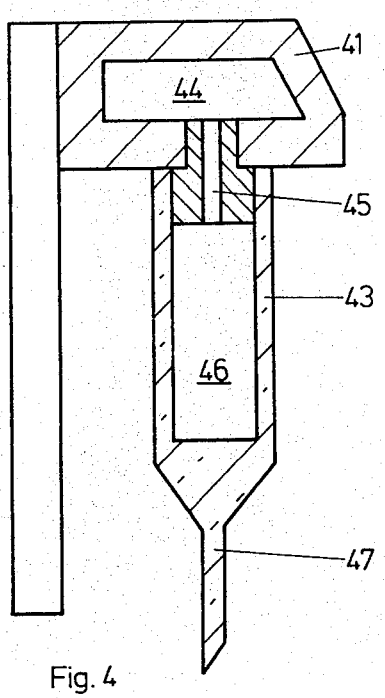
FIG. 4 illustrates a fourth embodiment of the gripper apparatus according to the invention including an extendable peg.

In the fourth embodiment of the gripper apparatus according to the invention shown in FIG. 4 a support beam 41 is shown. On this beam 41 pegs are mounted, each of which comprises, as the shown peg 43, a hollow space 46 defined by a cylindrical sleeve. The peg 43 and the extension 47 also in this arrangement form an integral piece of material. The support beam 41 is provided with a chamber 44 extending over its whole length. Each of the hollow spaces 46 of the pegs 43 arranged in the longitudinal direction of the beam is connected via the duct 45 with the chamber 44. The front end of the extension 47 is defined by a surface which is inclined with respect to the longitudinal axis of the extension 47. Using this last mentioned embodiment again the sliding of the extension 47 is facilitated.

In order to grip a bobbin tube, or a plurality of such bobbin tubes, using the apparatus shown in FIG. 4, the pegs 43 are inserted into the cylindrical interior space of the bobbin tubes. Thereupon the air pressure in chamber 44 is increased in such a manner that also the air pressure in the hollow chamber or space 46 is increased. As the walls of the pegs 43 are elastic, they extend laterally to such an extent, that they contact the inside walls of the bobbin tubes into which the pegs 43 are inserted, and that pegs and bobbin tubes are pressed against each other. In this manner these bobbin tubes can be gripped and transported.

If a bobbin tube is arranged in a faulty position, the extension 47 effects the action described with reference to the above mentioned embodiments. In this embodiment, however, the objective is not mainly to avoid damages to the support beam. A collision of the front end of the peg 43 with the upper rim of a bobbin tube, in case of absence of an extension 47, primarily causes the formation of cracks in the peg 43. This causes additionally a blowout of the above atmospheric pressure in the chamber 44, which causes, among other inconveniences, expensive down time.

The extensions 17,27,37,47 are provided preferentially with the following characteristics:

The length of the section extending from the front end of the peg towards the front is at least equal to one tenth of the length of the peg, at the most equal to half the length of the peg. The bounce-back hardness, or the elasticity respectively, of the extensions ranges between 25 and 90 degrees Shore. They are made preferentially from rubber or thermoplastic material.

While there are shown and described present preferred embodiments of the invention, it is to be distinctly understood that the invention is not limited thereto, but may be otherwise variously embodied and practiced within the scope of the following claims. Accordingly,

What I claim is:

1. A gripper apparatus for gripping bobbin tubes each having an interior space and placed at a ring spinning or ring twisting machine, said gripper apparatus comprising:

a movable support beam extending along the machine and provided with pegs directed towards the bobbin tubes;

each of said pegs having a tapered front end facing a related one of said bobbin tubes and each peg being insertable into the interior space of the related bobbin tube; and each said peg being provided with a substantially cylindrical extension formed by an elastically bendable material and extending forwardly from said tapered front end of said peg.

2. The gripper apparatus as defined in claim 1, wherein:

each peg is provided with an axial bore which extends from said tapered front end thereof; and said extension being of substantially circular cross-section and being mounted in said bore.

3. The gripper apparatus as defined in claim 1, wherein:

each peg comprises a metal cylinder;

said metal cylinder being provided with a tapered front section and an axial bore extending therethrough; and said extension being mounted in said bore.

4. The gripper apparatus as defined in claim 1, wherein:

each peg comprises a wall made of an elastically bendable material; and said extension being formed integrally with said wall.

5. The gripper apparatus as defined in claim 1, wherein:

said extension possesses a rounded front end.

6. The gripper apparatus as defined in claim 1, wherein:

said extension comprises an end face which is inclined with respect to a longitudinal axis of said extension.

7. The gripper apparatus as defined in claim 1, wherein:

each said peg and said extension have a respective predetermined length; and said predetermined length of said extension as measured from the front end of said peg is in the range of one-tenth to one-half of, said predetermined length of said peg.

8. The gripper apparatus as defined in claim 1, wherein:

said extension possesses a bounce-back hardness in the range of 25 to 90 degrees Shore.

9. The gripper apparatus as defined in claim 1, wherein:

said extension comprises a helical spring.

10. The gripper apparatus as defined in claim 1, wherein:

said extension is made of rubber.

11. The gripper apparatus as defined in claim 1, wherein:

said extension is formed from a thermoplastic material.

12. The gripper apparatus as defined in claim 1, wherein:

said elastically bendable and forwardly extending extension is configured to preclude impact of the tapered front end of the peg with a rim portion of the bobbin tube.

* * * * *